US008925521B2

(12) United States Patent
Lee

(10) Patent No.: US 8,925,521 B2
(45) Date of Patent: Jan. 6, 2015

(54) ADJUSTABLE THROTTLE BORE RESTRICTOR

(76) Inventor: Rollin Kim Lee, Panaca, NV (US)

( * ) Notice: Subject to any disclaimer, the term of this patent is extended or adjusted under 35 U.S.C. 154(b) by 844 days.

(21) Appl. No.: 13/172,820

(22) Filed: Jun. 29, 2011

(65) Prior Publication Data

US 2012/0000443 A1 Jan. 5, 2012

Related U.S. Application Data

(60) Provisional application No. 61/360,065, filed on Jun. 30, 2010.

(51) Int. Cl.
*F02D 9/08* (2006.01)
*F02D 9/14* (2006.01)

(52) U.S. Cl.
CPC ..... *F02D 9/14* (2013.01)
USPC ..... 123/403; 123/184.46; 123/359; 123/590

(58) Field of Classification Search
CPC ..... F02D 41/0002; F02D 9/1065; F02D 41/0007; F02M 35/10144; Y02T 10/42
USPC ..... 123/184.46, 359, 403, 590; 138/39
See application file for complete search history.

(56) References Cited

U.S. PATENT DOCUMENTS

| | | | | |
|---|---|---|---|---|
| 3,045,687 | A * | 7/1962 | Cramer | 137/56 |
| 3,304,068 | A * | 2/1967 | Thomas | 261/41.5 |
| 3,678,962 | A * | 7/1972 | Pierce, Jr. | 138/39 |
| 4,274,386 | A * | 6/1981 | Reyes | 123/591 |
| 5,235,948 | A * | 8/1993 | Grant et al. | 123/342 |
| 5,501,192 | A * | 3/1996 | Cutler | 123/336 |
| 5,619,960 | A * | 4/1997 | Funk | 123/184.46 |
| 5,642,712 | A * | 7/1997 | Biondo | 123/398 |
| 5,839,419 | A * | 11/1998 | Hawley | 123/398 |
| 5,947,085 | A * | 9/1999 | Deal | 123/389 |
| 6,189,505 | B1 * | 2/2001 | Reid | 123/336 |
| 6,595,175 | B1 * | 7/2003 | Capoferi et al. | 123/184.46 |
| 7,487,758 | B1 * | 2/2009 | Reid | 123/399 |
| 8,453,617 | B1 * | 6/2013 | Olson | 123/184.46 |
| 2008/0135009 | A1 * | 6/2008 | Wilson | 123/184.46 |

* cited by examiner

*Primary Examiner* — Hai Huynh
*Assistant Examiner* — Raza Najmuddin
(74) *Attorney, Agent, or Firm* — James A. Italia; Italia IP

(57) ABSTRACT

An adjustable restrictor device for controlling flow of induction air into an engine. The restrictor device may comprise a generally flat compact housing which is installed between a carburetor and intake manifold of an engine. The housing may have throughbores to allow air flow, which coincide in location to carburetor bores. The restrictor device may have two individual restrictors enclosed therein, each movable to positions which progressively obstruct and open the throughbores to control flow of inducted air. Each restrictor may be manually controlled in common by a rotatable control shaft. Threading of the knobs may be opposite handed, thereby enabling the restrictors to move similarly in effect as to controlling air flow but in opposite directions.

14 Claims, 3 Drawing Sheets

ADJUSTABLE THROTTLE BORE RESTRICTOR

REFERENCE TO RELATED APPLICATION

This application claims priority of a Provisional Patent Application filed Jun. 30, 2010, application No. 61/360,065, the contents of which are incorporated herein.

FIELD OF THE INVENTION

The present invention relates to a manually adjustable valve for controlling flow of inducted combustion air into an internal combustion engine.

BACKGROUND OF THE INVENTION

One form of drag racing which has become popular is known as bracket racing. The term "bracket" refers to a window of time that is required for the vehicle to start and complete a prescribed race course, typically a straight quarter mile course. In bracket racing, drag race vehicles are pitted against other such vehicles of generally similar racing abilities because for any given race, vehicles must have race times or alternatively stated, complete the course, in a time interval that is neither less than nor greater than the magnitude of the selected time interval or bracket.

The advantage of this arrangement is that it assures a fairly close race. Otherwise, all other things being equal, the race will be won by that competitor who has devoted more technical resources, and therefore financial resources, to developing a faster race vehicle. Limiting participation of race vehicles to predetermined time brackets both assures a close race, which is of greater interest to spectators, and imposes a limit on otherwise unlimited spending in an effort to become ever faster.

The concept of bracket racing essentially rewards consistency over sheer speed. That is, it becomes desirable to remain within a particular bracket to avoid disqualification in races. At the same time, it is desired to finish the race in an elapsed time period which is the minimum of the predetermined time bracket.

Vehicles for bracket racing have become so developed in their ability to finish races within a particular time bracket that influences such as ambient temperature, humidity, wind speed and direction, and other factors may cause a race vehicle to cover the course too fast and thus be disqualified, or to become slower to the point of being uncompetitive in the selected time bracket. A way of establishing fine control over maximum horsepower would address these problems.

In NASCAR racing, so-called restrictor plates are used to achieve a certain level of parity among race vehicles. While restrictor plates serve their intended purpose in stock car racing situations, they would not be truly useful in bracket constrained drag racing since they are fixed in their levels of control and cannot assure that the race vehicle on which one is placed will actually be limited to any particular elapsed time bracket.

There exists a need in bracket racing to be able to modify engines of race vehicles under closely controlled constraints to enable small adjustments of engine power to suit prevailing conditions in order for a particular race vehicle to qualify for and be competitive within a particular time bracket.

SUMMARY OF THE INVENTION

The present invention provides a compact device which is generally similar to a restrictor plate, but which provides ability to make fine adjustments to the degree of restriction which is achieved.

The novel restrictor device incorporates at least one adjustable restrictor which is movable to achieve infinite increments of adjustment, so that an engine may be tuned such that drag race results are confined to a particular predetermined elapsed time bracket. The adjustable restrictor moves laterally once placed on a typical engine, so that it moves perpendicularly to the flow of inducted air. The adjustable restrictor is compactly enclosed in a surrounding housing. One or more adjustment knobs may project laterally from the housing.

The number of restrictors may be more than one. Illustratively, in a currently preferred embodiment, two restrictors are provided, each restricting or controlling two carburetor bores of a four barrel carburetor for example. In this embodiment, each restrictor is provided with a common control shaft. The shaft may be passed through threaded holes formed in the housing, with the threading being of opposite hand so that the two restrictors are moved in opposite directions by the one control shaft.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
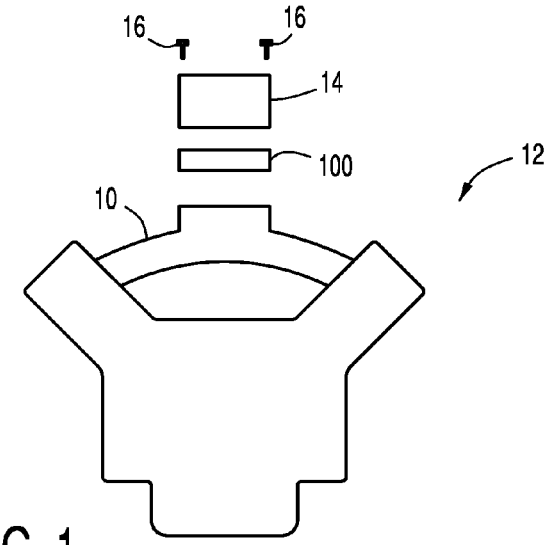
FIG. 1 is an exploded diagrammatic end view of a typical V8 or V6 engine, showing the mounting location of an adjustable restrictor according to an aspect of the invention.

Referring first to FIG. 1, according to at least one aspect of the invention, there is shown an adjustable restrictor device 100 as it would be installed onto the intake manifold 10 of an internal combustion engine 12. After assembly, the adjustable restrictor device 100 will be sandwiched between the intake manifold 10 and a carburetion device such as a carburetor 14 or fuel injection throttle body (not shown). The adjustable restrictor device 100 may be held in place by fasteners 16 which secure the carburetion device to the intake manifold 10. Although shown as bolts, the fasteners 16 may comprise studs (not shown) anchored in the intake manifold 10 and cooperating nuts (not shown). After installation, the adjustable restrictor device 100 will be fairly inconspicuous and will add to only a limited degree to the overall height of the engine assembly. After installation, and as will be further detailed hereinafter, the adjustable restrictor device 100 may be utilized to control flow of inducted combustion air into the internal combustion engine 12.

Figure 2:
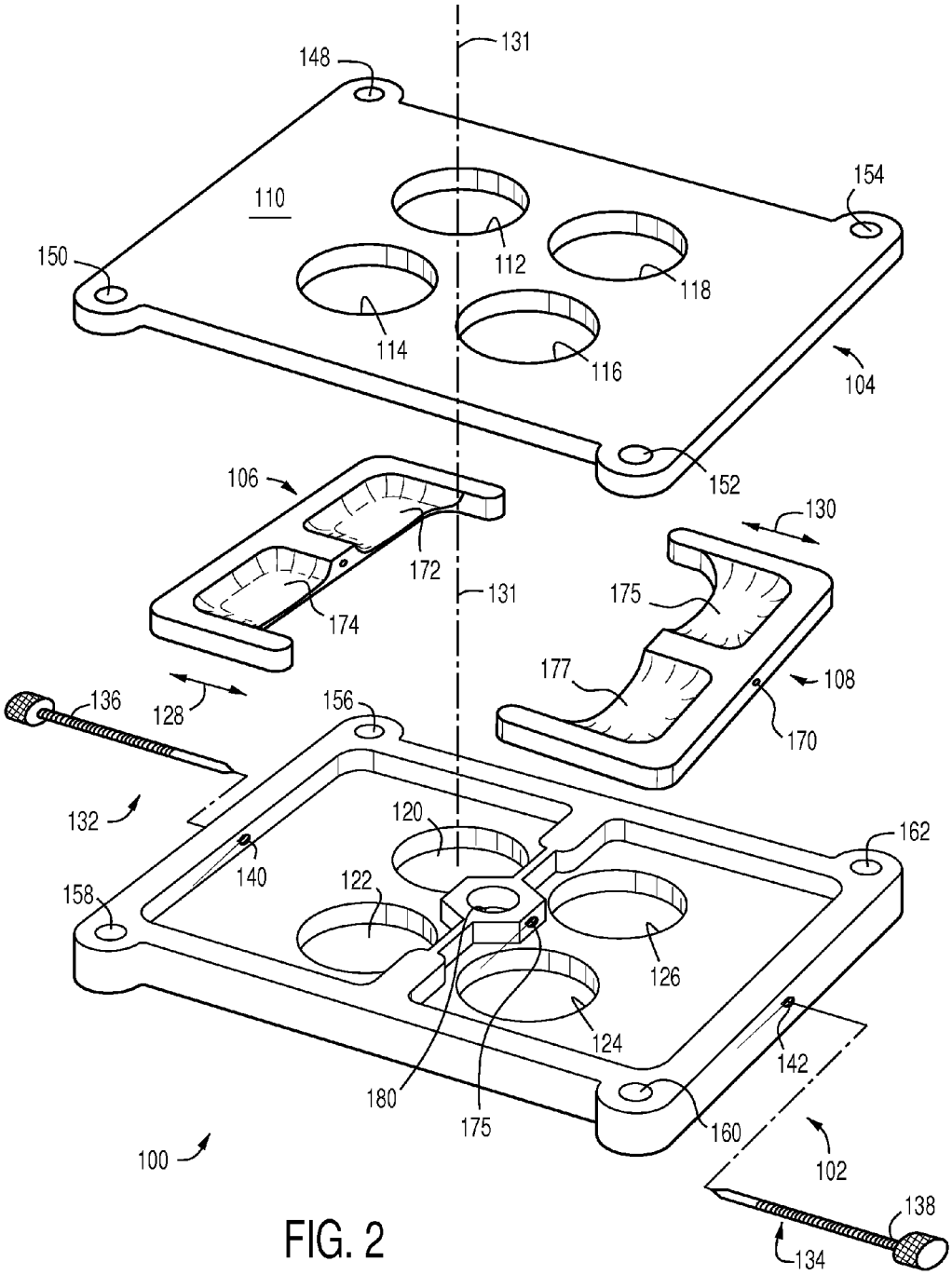
FIG. 2 is an exploded perspective view of an adjustable restrictor according to at least one aspect of the invention.

FIG. 2 shows the principal components of the adjustable restrictor device 100, which principal components include a base 102, a cover 104, and two gate valves or restrictors 106, 108. The base 102 and cover 104 collectively form a housing comprising a face surface 110 which is disposed perpendicularly to the direction of combustion air flowing through the housing into the engine, such as the internal combustion engine 12.

The base 102 and the cover 104 provide two complementing sections which when assembled result in an internal chamber being formed therebetween. The restrictors 106, 108 are contained within the internal chamber.

The base 102 and cover 104 respectively bear a plurality of openings 112, 114, 116, 118, 120, 122, 124, 126, 128 for passing air into the engine. The openings 112, 114, 116, 118, 120, 122, 124, 126, 128 are formed in surfaces parallel to the face surface 110, and further may be disposed in vertical registry with corresponding throttle bores (not shown) formed in the carburetion device. Illustratively, the carburetion device may be a four barreled carburetor (not shown) having four throttle bores. The openings 112, 114, 116, 118, 120, 122, 124, 126, 128 may each have an axis such as the axis 131 which coincides with the openings of the carburetor. It may be stressed at this point that the face surface 110 is important only in that it provides semantic basis for a hypothetical plane which passes through the adjustable restrictor 100 and is perpendicular to the flow of air through the various openings 112, 114, 116, 118, 120, 122, 124, 126, 128.

After assembly, the base 102 and cover 104 seal the induction passage established by the carburetion device and intake manifold from ambient air, so that characteristics of air and fuel flow are not altered during passage from the carburetion device to the intake manifold. The role of the adjustable restrictor device 100 is to selectively increase and decrease maximum air and fuel flow so as to selectively limit maximum power which may be developed by the engine.

Increasing and decreasing air and fuel flow, which will be referred to subsequently as throttling, is accomplished by adjusting position of the restrictors 106, 108 so as to selectively partially obstruct the effective surface area of the openings 112, 114, 116, 118, 120, 122, 124, 126, 128. Although the restrictors may be moved in other directions if desired, results are obtained efficiently by moving the restrictors 106, 108 perpendicularly to the direction of combustion air flowing through the adjustable restrictor device 100, or alternatively stated, the restrictors 106, 108, which are supported by the housing and fully enclosed therein., are each disposed to move in a direction generally parallel to the face surface 110 of the housing.

The restrictor 106 may have gently rounded shallow troughs 172, 174 formed therein. The restrictor 108 may have comparable troughs 175, 177.

The restrictors 106, 108 may be disposed to move in mutual opposition to one another in the directions indicated by the arrows 128, 130 in the following way. Each restrictor 106 or 108 may be controlled by a control shaft which may comprise a first control shaft section 132 and a second control shaft section 134. The control shaft may have external threading sections 136, 138 respectively, which external threading sections 136, 138 cooperate with corresponding threaded holes 140, 142 formed in the base 102. The control shaft sections 132, 134 are joined together, for example by welding, adhering, rivets, threaded fasteners, or other means (not shown) after inserting each control shaft section 132 or 134 into place from opposite sides of the housing. After the control shaft section 134 is passed through a hole 175, and the control shaft section 132 is passed through a corresponding hole (not visible in the view of FIG. 2) from the opposite side of the housing, the tips of the two control shaft sections 132, 134 may be welded together using the opening 180 for welding access. Alternatively the control shaft utilized may merely be a single rod with portions of thread of opposite pitch.

The resultant single control shaft is rotatably supported on the housing in an orientation such that it may move the restrictors 106, 108 in opposite directions (such as indicated by the arrows 128, 130) parallel to the face surface 110 of the cover 104 when rotated by either end (e.g., the section 132 or the section 134). Further rotation exerts a force on the respective restrictor 106 or 108 and moves the restrictor 106 or 108 to a new position. When supported in a threaded hole such as the threaded 140 or 142, it follows that rotation of the enlarged head 144 or 146 will cause the control shaft to move helically.

Figure 3:
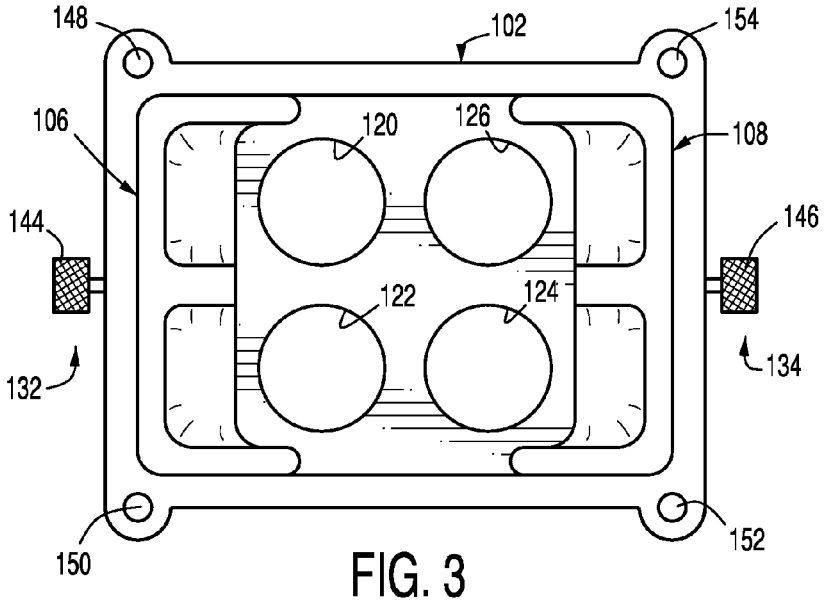
FIG. 3 is a top plan view of the components of FIG. 2, with the uppermost component removed to reveal internal positional details, with gate valve elements shown in one position of a range of adjustment positions.
Figure 4:
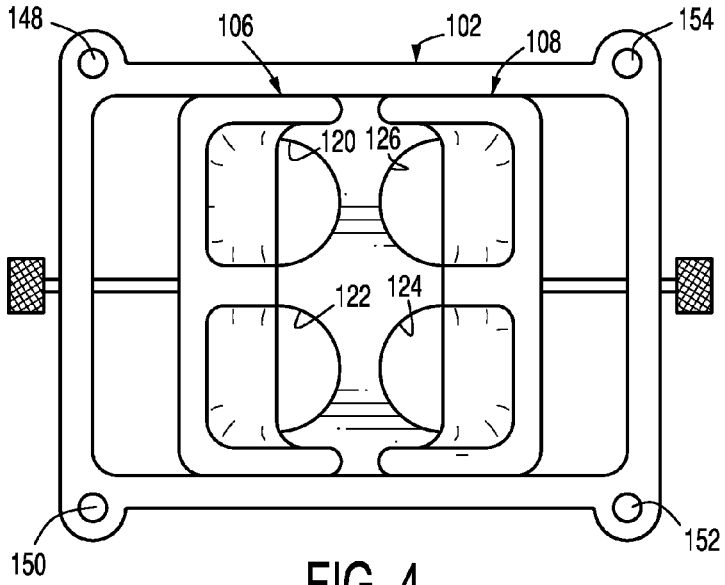
FIG. 4 is a top plan view similar to FIG. 3, but showing the gate valve elements adjusted to another position of the range of adjustment positions.

The effect of moving the restrictors 106, 108 to new positions is illustrated in FIGS. 3 and 4. In FIG. 3, the restrictors 106, 108 are shown at the outer limits of travel such that the openings 120, 122, 124, 126 are fully exposed to air flow. It should be appreciated that the control shaft (the welded control shaft sections 132, 134) remains at a generally constant or unmoved location on the housing, and the restrictors 106, 108 move laterally along the control shaft as they traverse the threaded portions 136, 138.

As seen in FIG. 4, the control shaft may be rotated to adjust the restrictors 106, 108 to new positions in which the openings 120, 122, 124, 126 are partially obstructed. As depicted in FIG. 4, this movement leaves a gap to the left of the restrictor 106 and a gap to the right of the restrictor 108 through which gaps the control shaft becomes revealed.

For convenience of operation, the control shaft projects to the exterior of the housing so as to be accessible for movement from the exterior thereof. The control shaft 134 may be grasped and rotated by hand using either of respective enlarged knurled heads 144, 146.

The control shaft also may perform the function of repeatably resetting the restrictors 106, 108. For example, the restrictors 106, 108 may be adjusted to the fully obstructed position, and then adjusted by rotating the control shaft by a predetermined definite number of turns. The user may monitor ambient weather conditions such as barometric pressure, humidity, temperature, wind speed and direction, and the like, and may make adjustments to the initial setting established by the predetermined number of turns of the control shaft. The results may be noted, with degree of fine control due to weather conditions being factored in to modify the initial setting in subsequent racing.

The restrictors 106, 108 may be arranged to move in mutual opposition to one another. That is, as the restrictor 106 is adjusted from the position shown in FIG. 3 to the position shown in FIG. 4, the restrictor 108 moves similarly but in an opposite direction of travel. With the threading sections 136, 138 each being of opposite hand to the other, each of the threading sections 136, 138 controlling one restrictor 106 or 108, either enlarged knurled head 144 or 146 may be grasped by one hand and rotated with the fingers. Thus the restrictors 106, 108 may be moved in opposite directions despite one direction of rotation of their respective control shaft. Similar adjustments may be made by rotating either of the enlarged knurled heads 144 or 146. Because the control shaft projects from the housing at opposite sides of the housing, each of the enlarged knurled heads 144 or 146 is located on one side of the adjustable restrictor assembly 100. This affords the convenience of being able to adjust the restrictors 106, 108 from different locations. Although the present application discloses an embodiment utilizing two knurled heads 144, 146, it should be appreciated that the present invention may be operated by a single knurled head.

It will be apparent from examining FIG. 2 that bolt holes 148, 150, 152, 154 formed in the cover 104 are generally coaxial with bolt holes 156, 158, 160, 162 formed in the base 102. These bolt holes 148, 150, 152, 154, 156, 158, 160, 162 may be located and dimensioned so as to cooperate with the bolt pattern established by the fasteners 16 (see FIG. 1), and may for example, duplicate the function of similar fasteners originally provided by the manufacturer of the engine 12 to mount the carburetion device to the intake manifold 10.

Figure 5:
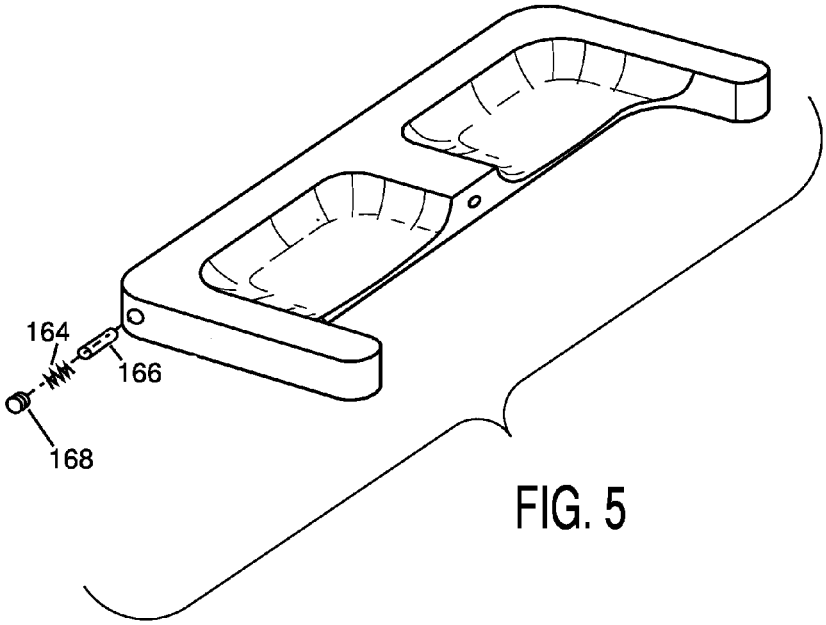
FIG. 5 is an exploded perspective detail view of one gate valve element and associated components.

FIG. 5 shows a feature for immobilizing a restrictor such as the restrictor 106 in a selected position of adjustment. A small spring 164 may be arranged to impose force on a block 166. The small spring 164 may seat at one end against a threaded set screw 168 which is inserted into the restrictor 106 to contain the spring 164 and at the other end, against an end surface of the block 166. The block 166 is forced by the spring to make contact with the adjusting screw threads 136 (not shown in FIG. 5) imposing forces which act to pin the threaded shaft 132 (also not shown in FIG. 5) in place so that adjustment of the restrictor is preserved.

The present invention may be modified in many ways to similar effect. For example, whereas the cover 104 and the base 102 are shown as having four openings 112, 114, 116, 118, 120, 122, 124, 126 respectively, the number and configuration of these openings 112, 114, 116, 118, 120, 122, 124, 126 may be varied to suit conditions for each engine or to suit manufacturing convenience. For example, pairs of openings such as the openings 112, 114 may be made to communicate or alternatively stated, may be siamesed.

The number of restrictors such as the restrictors 106, 108 may be increased or decreased. For example, each opening 112, 114, 116, 118 may be provided with an individual restrictor (not shown) if desired. Restrictors may be yoked together and adjusted by only one control shaft (this option is not shown).

The housing may be formed as a pocket open at only one end, with a suitable restrictor or restrictors inserted through the open end if desired (this option is not shown).

The control shaft arrangement may be modified to include traveling nuts (not shown) which propel the respective restrictors such as the restrictors 106, 108 by interference. A singular control shaft may be replaced by plural control shafts (not shown, each control shaft controlling a different restrictor. For example, the restrictors 106, 108 each have an opening such as the opening 170 for receiving the tip of a control shaft such as the control shaft 134. Such an opening may be modified to enclose and entrap an enlarged terminal so that the associated restrictor is subjected to pulling forces when the control shaft is rotated in one direction and subjected to pushing forces when the control shaft is rotated in the other direction.

Components of the adjustable restrictor device 100 shown coupled to the base 102 may be coupled to the cover 104 where feasible.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. An adjustable restrictor device for controlling flow of inducted combustion air into an internal combustion engine having a carburetion device and an intake manifold, comprising:

a housing comprising a face surface bearing at least one opening for passing combustion air through the housing in a direction generally perpendicular to the face surface, the opening having an axis coinciding with direction of combustion air flowing through the adjustable restrictor;

at least one restrictor supported by the housing and fully enclosed therein, wherein each restrictor is disposed to move in a direction generally parallel to the face surface of the housing;

and a control shaft disposed to engage the restrictor so as to move the restrictor in the direction parallel to the face surface of the housing, wherein the control shaft projects to the exterior of the housing so as to be accessible for movement from the exterior of the housing, wherein the control shaft is rotatably supported on the housing in a threaded hole and is disposed to move helically in the direction parallel to the face surface of the housing when the control shaft is rotated.

2. The adjustable restrictor device of claim 1, wherein the at least one restrictor comprises a plurality of restrictors each moving in mutual opposition to another restrictor.

3. The adjustable restrictor device of claim 1, wherein there are two restrictors each controlled by the control shaft, each restrictor has a threaded hole for receiving the control shaft, and threading of the threaded holes of the restrictors is opposite handed, whereby rotation of the control shaft in one direction will move the two restrictors in opposite directions relative to one another.

4. The adjustable restrictor device of claim 3, wherein each one of the restrictors has two openings for passing air into the engine.

5. The adjustable restrictor device of claim 1, wherein the housing is formed in two complementing sections which result in an internal chamber being formed between the two complementing sections when the housing is assembled, and each restrictor is contained within the internal chamber.

6. The adjustable restrictor device of claim 1, wherein the at least one opening formed in the housing for passing combustion air comprises a plurality of openings.

7. The adjustable restrictor device of claim 1, wherein the housing comprises at least two bolt holes formed in the face surface of the housing and passing entirely through the housing, for accepting fasteners to mount the adjustable restrictor to the engine.

8. An adjustable restrictor device for controlling flow of inducted combustion air into an internal combustion engine having a carburetion device and an intake manifold, comprising:

a housing comprising a face surface bearing at least one opening for passing combustion air through the housing in a direction generally perpendicular to the face surface, the opening having an axis coinciding with direction of combustion air flowing through the adjustable restrictor;

at least one restrictor supported by the housing and fully enclosed therein, wherein each restrictor is disposed to move in a direction generally parallel to the face surface of the housing;

and a control shaft disposed to engage the restrictor so as to move the restrictor in the direction parallel to the face surface of the housing, wherein the control shaft projects to the exterior of the housing so as to be accessible for movement from the exterior of the housing, further comprising a setscrew disposed to pin the control shaft in place so that adjustment of the restrictor is preserved.

9. An adjustable restrictor device for controlling flow of inducted combustion air into an internal combustion engine having a carburetion device and an intake manifold, comprising:

a housing comprising a face surface bearing at least one opening for passing combustion air through the housing in a direction generally perpendicular to the face surface, the opening having an axis coinciding with direction of combustion air flowing through the adjustable restrictor;

at least one restrictor supported by the housing and fully enclosed therein, wherein each restrictor is disposed to move in a direction generally parallel to the face surface of the housing, wherein each restrictor has a shallow trough formed therein;

and a control shaft disposed to engage the restrictor so as to move the restrictor in the direction parallel to the face surface of the housing, wherein the control shaft projects to the exterior of the housing so as to be accessible for movement from the exterior of the housing.

10. An adjustable restrictor device for controlling flow of inducted combustion air into an internal combustion engine having a carburetion device and an intake manifold, comprising:

a housing comprising a face surface bearing at least one opening for passing combustion air through the housing in a direction generally perpendicular to the face surface, the opening having an axis coinciding with direction of combustion air flowing through the adjustable restrictor;

at least one restrictor supported by the housing and fully enclosed therein, wherein each restrictor is disposed to move in a direction generally parallel to the face surface of the housing;

and a control shaft disposed to engage the restrictor so as to move the restrictor in the direction parallel to the face surface of the housing, wherein the control shaft projects to the exterior of the housing so as to be accessible for movement from the exterior of the housing, wherein the control shaft projects from the housing at opposite sides of the housing, and the control shaft comprises one enlarged head located on each side of the adjustable restrictor assembly.

11. The adjustable restrictor device of claim 10, wherein the control shaft is fabricated by providing a first control shaft section and a second control shaft section each having external threading sections, and joining the first control shaft section to the second control shaft section after inserting each control shaft section into place from opposite sides of the housing by passing each control shaft section through holes formed in the housing and welding the tips of the control shaft sections together.

12. An internal combustion engine comprising an intake manifold, a carburetion device, and an adjustable restrictor device disposed between the intake manifold and the carburetion device, wherein the adjustable restrictor device comprises a housing comprising a face surface bearing at least one opening for passing combustion air through the housing in a direction generally perpendicular to the face surface, the opening having an axis coinciding with direction of combustion air flowing through the adjustable restrictor, at least one restrictor supported by the housing and fully enclosed therein, wherein each restrictor is disposed to move in a direction generally parallel to the face surface of the housing, and a control shaft disposed to engage the restrictor so as to move the restrictor in the direction parallel to the face surface of the housing, wherein the control shaft projects to the exterior of the housing so as to be accessible for movement from the exterior of the housing, wherein the control shaft is rotatably supported on the housing in a threaded hole and is disposed to move helically in the direction parallel to the face surface of the housing when the control shaft is rotated.

13. The internal combustion engine of claim 12, wherein the adjustable restrictor device is held in place by fasteners which also secure the carburetion device to the intake manifold.

14. The internal combustion engine of claim 13, wherein the adjustable restrictor device has boll holes for accepting the fasteners which secure the carburetion device to the intake manifold, wherein the bolt holes are located and dimensioned so as to cooperate with the bolt pattern established by the fasteners which secure the carburetion device to the intake manifold.

* * * * *